US005435538A

United States Patent [19]

Billings et al.

[11] Patent Number: 5,435,538

[45] Date of Patent: Jul. 25, 1995

[54] RETARD ROLL WITH INTEGRAL TORQUE LIMITING SLIP CLUTCH WITH REVERSING BIAS

[75] Inventors: Philip A. Billings, Fairport; Ermanno C. Petocchi, Rochester, both of N.Y.

[73] Assignee: Xerox Corporation, Stamford, Conn.

[21] Appl. No.: 176,186

[22] Filed: Jan. 3, 1994

[51] Int. Cl.[6] ..... B65H 3/54; B65H 3/52

[52] U.S. Cl. ..... 271/34; 271/122

[58] Field of Search ..... 271/121, 122, 116, 34

[56] References Cited

U.S. PATENT DOCUMENTS

| | | | |
|---|---|---|---|
| 3,961,786 | 6/1976 | Yanker | 271/10 X |
| 4,203,586 | 5/1980 | Hoyer | 271/34 |
| 4,368,881 | 1/1983 | Landa | 271/122 |
| 5,016,866 | 5/1991 | Takahashi | 271/122 |
| 5,039,080 | 8/1991 | Kato et al. | 271/122 |
| 5,085,420 | 2/1992 | Sata | 271/122 X |
| 5,238,236 | 8/1993 | Belec | 271/122 X |

FOREIGN PATENT DOCUMENTS

| | | | |
|---|---|---|---|
| 0157653 | 9/1983 | Japan | 271/116 |
| 3-128835 | 5/1991 | Japan | 271/122 |
| 3-256944 | 11/1991 | Japan | 271/122 |

*Primary Examiner*—H. Grant Skaggs
*Attorney, Agent, or Firm*—Kevin R. Kepner

[57] ABSTRACT

A retard sheet feeder that utilizes a slip clutch with an integral biasing device to separate double fed sheets. A retard roll is provided in circumferential contact with a feed roll to form a drive nip. The retard roll is free to rotate in the feeding direction by the use of a spring that is axially aligned with the roll and allows the roll to slip in the feed direction once a predetermined torque level is reached. The spring may be either internal to the roll or external to the roll. When the drive torque to the retard roll is reduced such as when a double sheet is in the drive nip, the torque is not sufficient to overcome the stored spring energy and the roll is rotated in a reverse direction by the spring to drive the double sheet out of the nip. Once the double sheet is removed from the nip the frictional contact between the drive roll, a single sheet and the retard roll again winds the spring to the predetermined torque level at which point the spring slips allowing the retard roll to overrun in the feed direction.

10 Claims, 4 Drawing Sheets

RETARD ROLL WITH INTEGRAL TORQUE LIMITING SLIP CLUTCH WITH REVERSING BIAS

This invention relates generally to a sheet feeder, and more particularly concerns sheet feeder having a reversing retard roll utilizing an integral torque limiting slip clutch having a reversing bias.

In a typical electrophotographic printing process, a photoconductive member is charged to a substantially uniform potential so as to sensitize the surface thereof. The charged portion of the photoconductive member is exposed to a light to selectively dissipate the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In a commercial printing machine of the foregoing type, a sheet misfeed or multi-fed sheets can seriously impair the operation of the machine. It is advantageous in many of today's machines to provide for the in seriatim feeding of sheets from the top of the stack. Many devices have been developed to attempt to alleviate problems associated with feeding sheets and prevent multi-fed sheets. The present invention improves over past systems by by providing a simple integral device to separate multi-feeds quickly and effectively.

The following disclosures may be relevant to various aspects of the present invention:

U.S. Pat. No. 5,039,080
Patentee: Kato et al.
Issue Date: Aug. 13, 1991
U.S. Pat. No. 4,368,881
Patentee: Landa
Issue Date: Jan. 18, 1983
U.S. Pat. No. 4,203,586
Patentee: Hoyer
Issue Date May 20, 1980

The relevant portions of the foregoing disclosures may be briefly summarized as follows:

U.S. Pat. No. 5,039,080 describes a sheet feeding apparatus having a feed roller and a separating roller forming a nip utilizing a rotation resisting torque limiter and a spring to resiliently urge the separating roller in the reverse direction when a double fed sheet is in the nip.

U.S. Pat. No. 4,368,881 discloses a top feed friction retard feeder that utilizes a spring loaded retard roll and a torque limiter to bias the reverse rotation at a predetermined torque level.

U.S. Pat. No. 4,203,586 describes a multi-feed detection system including a drag roll in contact with a feed belt wherein a slip clutch applies a torque to the drag roll. A double fed sheet causes the drag roll to hesitate which is then detected by a sensor to activate a shut down as a result of the double fed sheet.

In accordance with one aspect of the present invention, there is provided an apparatus adapted to separate and advance sheets. The apparatus comprises a sheet advancing device and a retard roll in frictional contact with the advancing device and forming a nip therewith through which a sheet passes and a unitary, dual function torque limiting biasing device, cooperating with the retard roll to allow the retard roll to rotate in a first direction as single sheets pass through the nip and to storing energy to rotate the retard roll in a second direction, opposite the first direction, to move the sheets in the opposite direction to that of a single sheet passing through the nip in response to a plurality of sheets passing into the nip.

Pursuant to another aspect of the invention there is provided an electrophotographic printing machine of the type in which sheets are separated and fed from a stack. The improvement comprises a sheet advancing device and a retard roll in frictional contact with the advancing device and forming a nip therewith through which a sheet passes and a unitary, dual function torque limiting biasing device, cooperating with the retard roll to allow the retard roll to rotate in a first direction as single sheets pass through the nip and to storing energy to rotate the retard roll in a second direction, opposite the first direction, to move the sheets in the opposite direction to that of a single sheet passing through the nip in response to a plurality of sheets passing into the nip.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 7:
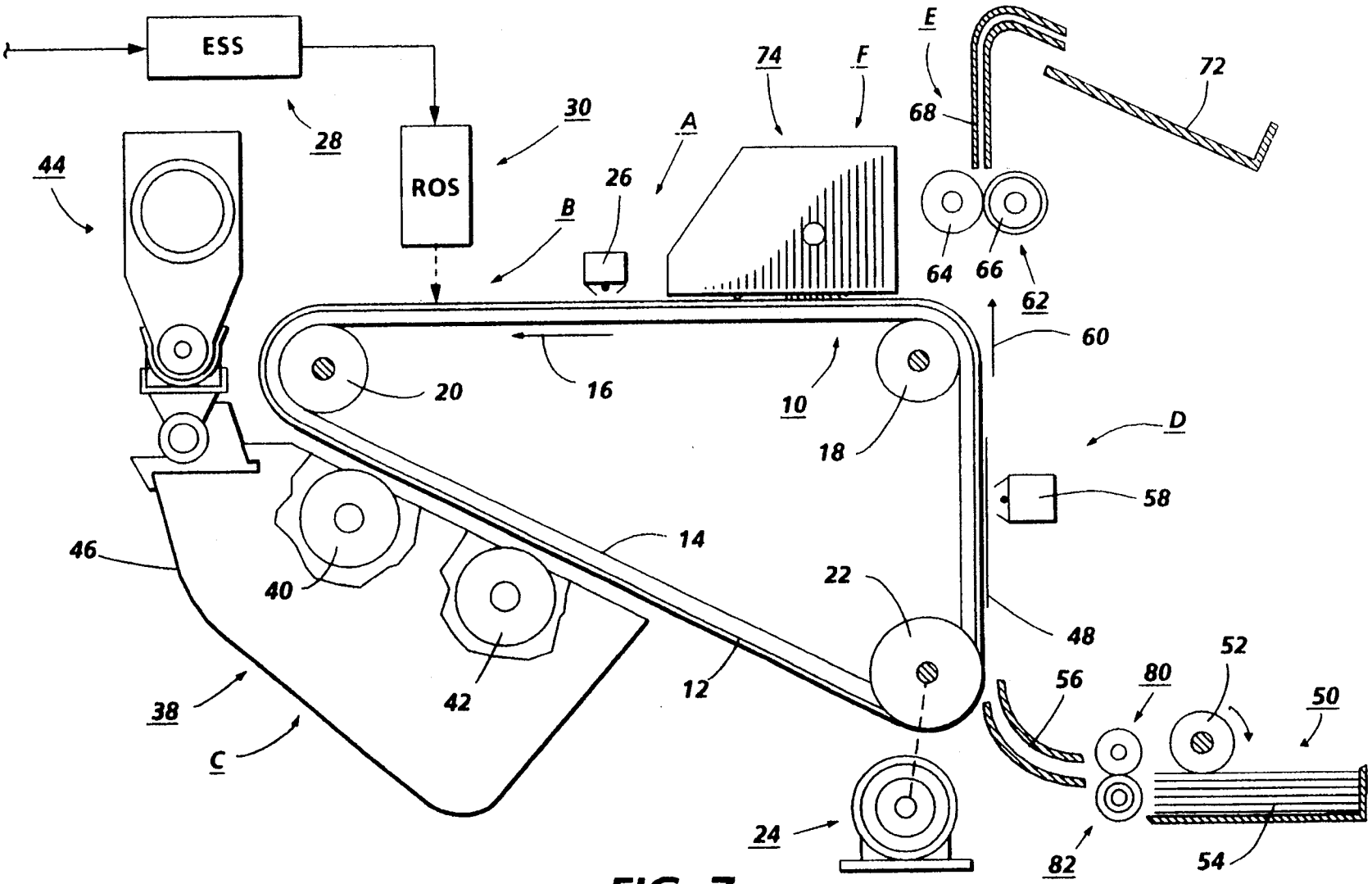
FIG. 7 is a schematic elevational view of an electrophotographic printing machine including the retard roll feeder of the present invention therein.

For a general understanding of the features of the present invention, reference is made to the drawings. In the drawings, like reference numerals have been used throughout to identify identical elements. FIG. 7 schematically depicts an electrophotographic printing machine incorporating the features of the present invention therein. It will become evident from the following discussion that the sheet feeding apparatus of the present invention may be employed in a wide variety of devices and is not specifically limited in its application to the particular embodiment depicted herein.

FIG. 7 schematically illustrates an electrophotographic printing machine which generally employs a belt 10 having a photoconductive surface 12 deposited on a conductive ground layer 14. Preferably, photoconductive surface 12 is made from a photoresponsive material, for example, one comprising a charge generation layer and a transport layer. Conductive layer 14 is made preferably from a thin metal layer or metallized polymer film which is electrically grounded. Belt 10 moves in the direction of arrow 16 to advance successive portions of photoconductive surface 12 sequentially through the various processing stations disposed about the path of movement thereof. Belt 10 is entrained about stripping roller 18, tensioning roller 20 and drive roller 22. Drive roller 22 is mounted rotatably in engagement with belt 10. Motor 24 rotates roller 22 to advance belt 10 in the direction of arrow 16. Roller 22 is coupled to motor 24 by suitable means, such as a drive belt. Belt 10 is maintained in tension by a pair of springs (not shown) resiliently urging tensioning roller 20 against belt 10 with the desired spring force. Stripping roller 18 and tensioning roller 20 are mounted to rotate freely.

Initially, a portion of belt 10 passes through charging station A. At charging station A, a corona generating device, indicated generally by the reference numeral 26 charges the photoconductive surface, 12, to a relatively high, substantially uniform potential. After photoconductive surface 12 of belt 10 is charged, the charged portion thereof is advanced through exposure station B.

At an exposure station, B, a controller or electronic subsystem (ESS), indicated generally by reference numeral 28, receives the image signals representing the desired output image and processes these signals to convert them to a continuous tone or greyscale rendition of the image which is transmitted to a modulated output generator, for example the raster output scanner (ROS), indicated generally by reference numeral 30. Preferably, ESS 28 is a self-contained, dedicated minicomputer. The image signals transmitted to ESS 28 may originate from a computer, thereby enabling the electrophotographic printing machine to serve as a remotely located printer for one or more computers. Alternatively, the printer may serve as a dedicated printer for a high-speed computer. The signals from ESS 28, corresponding to the continuous tone image desired to be reproduced by the printing machine, are transmitted to ROS 30. ROS 30 includes a laser with rotating polygon mirror blocks. Preferably, a nine facet polygon is used. The ROS illuminates the charged portion of photoconductive belt 20 at a resolution of about 300 or more pixels per inch. The ROS will expose the photoconductive belt to record an electrostatic latent image thereon corresponding to the continuous tone image received from ESS 28. As an alternative, ROS 30 may employ a linear array of light emitting diodes (LEDs) arranged to illuminate the charged portion of photoconductive belt 20 on a raster-by-raster basis.

In another embodiment, ESS 28 may be connected to a raster input scanner (RIS). The RIS has an original document positioned thereat. The RIS has document illumination lamps, optics, a scanning drive, and photosensing elements, such as an array of charge coupled devices (CCD). The RIS captures the entire image from the original document and converts it to a series of raster scanlines which are transmitted as electrical signals to ESS 28. ESS 28 processes the signals received from the RIS and converts them to greyscale image intensity signals which are then transmitted to ROS 30. ROS 30 exposes the charged portion of the photoconductive belt to record an electrostatic latent image thereon corresponding to the greyscale image signals received from ESS 28.

After the electrostatic latent image has been recorded on photoconductive surface 12, belt 10 advances the latent image to a development station, C, where toner, in the form of liquid or dry particles, is electrostatically attracted to the latent image using commonly known techniques. Preferably, at development station C, a magnetic brush development system, indicated by reference numeral 38, advances developer material into contact with the latent image. Magnetic brush development system 38 includes two magnetic brush developer rollers 40 and 42. Rollers 40 and 42 advance developer material into contact with the latent image. These developer rollers form a brush of carrier granules and toner particles extending outwardly therefrom. The latent image attracts toner particles from the carrier granules forming a toner powder image thereon. As successive electrostatic latent images are developed, toner particles are depleted from the developer material. A toner particle dispenser, indicated generally by the reference numeral 44, dispenses toner particles into developer housing 46 of developer unit 38.

With continued reference to FIG. 7, after the electrostatic latent image is developed, the toner powder image present on belt 10 advances to transfer station D. A print sheet 48 is advanced to the transfer station, D, by a sheet feeding apparatus, 50. Preferably, sheet feeding apparatus 50 includes a feed roll 52 contacting the uppermost sheet of stack 54. Feed roll 52 rotates to advance the uppermost sheet from stack 54 to retard feeder 80 which separates any double fed sheets before forwarding the sheet into chute 56. Chute 56 directs the advancing sheet of support material into contact with photoconductive surface 12 of belt 10 in a timed sequence so that the toner powder image formed thereon contacts the advancing sheet at transfer station D. Transfer station D includes a corona generating device 58 which sprays ions onto the back side of sheet 48. This attracts the toner powder image from photoconductive surface 12 to sheet 48. After transfer, sheet 48 continues to move in the direction of arrow 60 onto a conveyor (not shown) which advances sheet 48 to fusing station E.

The fusing station, E, includes a fuser assembly, indicated generally by the reference numeral 62, which permanently affixes the transferred powder image to sheet 48. Fuser assembly 60 includes a heated fuser roller 64 and a back-up roller 66. Sheet 48 passes between fuser roller 64 and back-up roller 66 with the toner powder image contacting fuser roller 64. In this manner, the toner powder image is permanently affixed to sheet 48. After fusing, sheet 48 advances through chute 68 to catch tray 72 for subsequent removal from the printing machine by the operator.

After the print sheet is separated from photoconductive surface 12 of belt 10, the residual toner/developer and paper fiber particles adhering to photoconductive surface 12 are removed therefrom at cleaning station F. Cleaning station F includes a rotatably mounted fibrous brush in contact with photoconductive surface 12 to disturb and remove paper fibers and a cleaning blade to remove the nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the features of the present invention therein.

Figure 1:
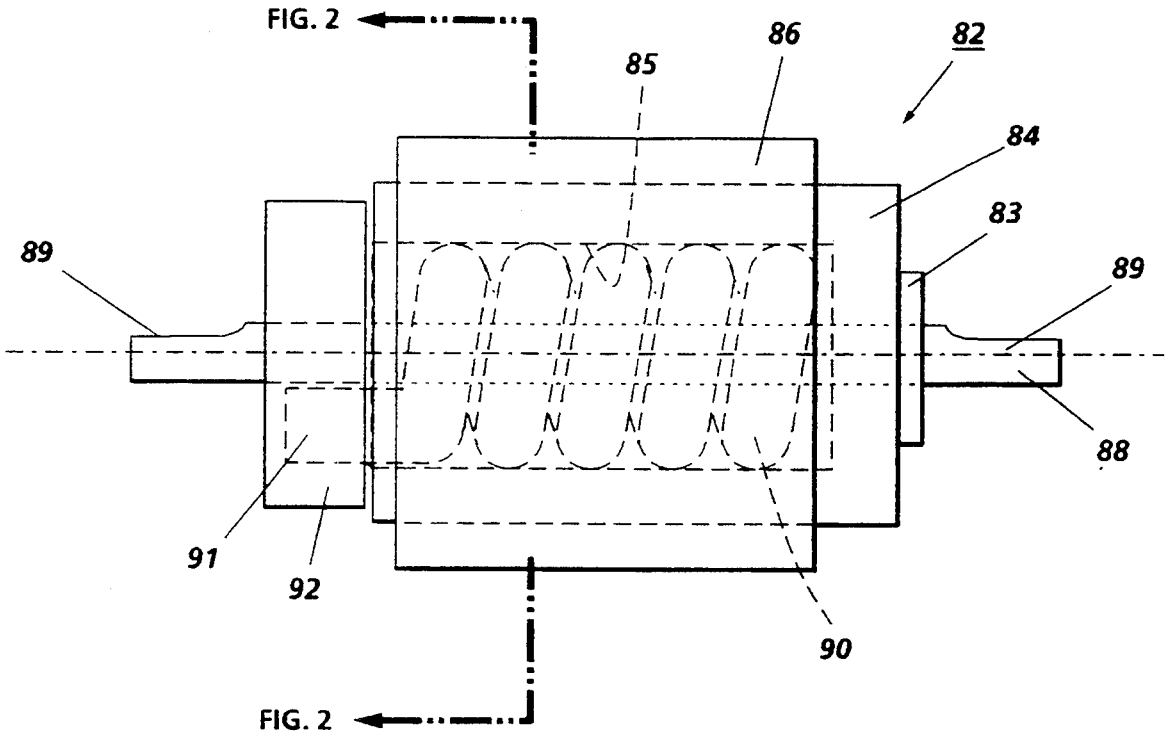
FIG. 1 is an elevational view of a first embodiment of the retard roll with the integral biasing device of the present invention.
Figure 2:
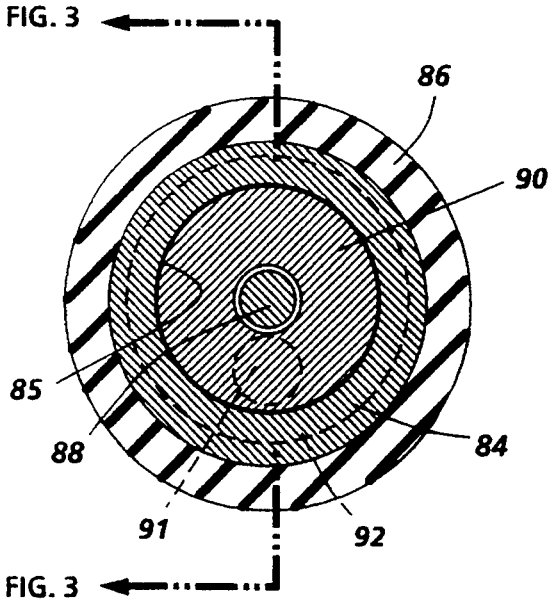
FIG. 2 is an end sectional view of the FIG. 1 roll taken along the line in the direction of arrows 2—2.
Figure 3:
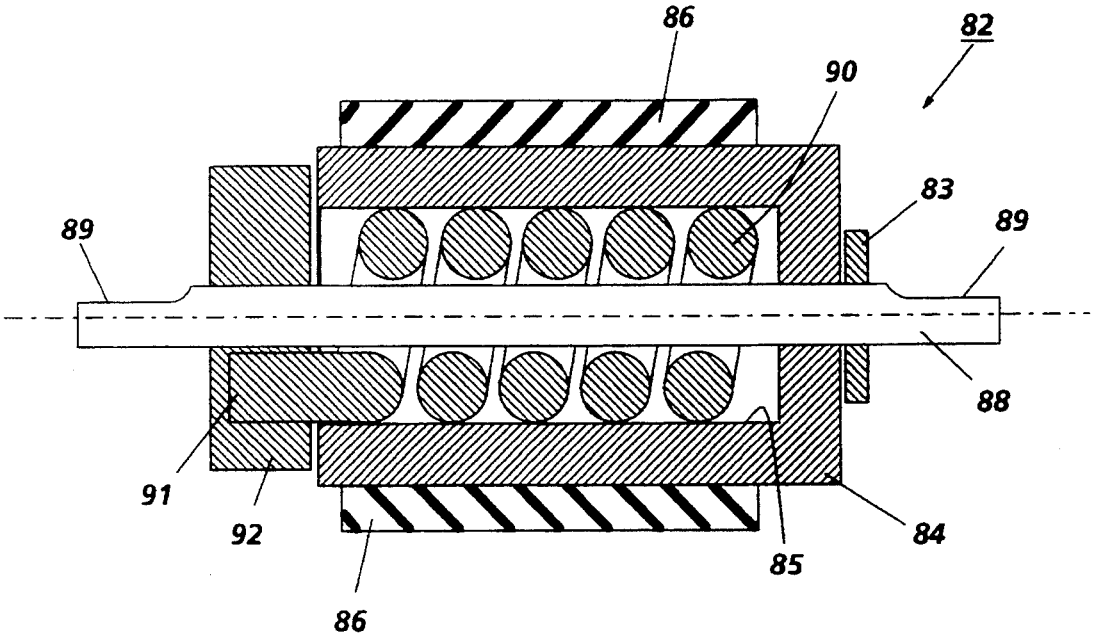
FIG. 3 is a sectional elevational view of the FIG. 1 roll taken along the line in the direction of arrows 3—3 in FIG. 2.

Turning now to FIGS. 1 through 3, the details of the first embodiment of the retard roll assembly generally referred to by reference 82 with the integral reverse biasing device will be discussed. The retard roll is formed from a cylindrical section 84 supported for rotation on a fixed shaft 88. The shaft has flats 89 at each end which allow it to be held in a fixed position. The cylindrical portion 84 is coated with an elastomeric surface 86 such as silicone rubber which provides good frictional contact with the sheets being fed and is impervious to commonly used silicone release agents. Internal to the cylindrical portion is a wrapped spring 90 coaxially aligned with the cylindrical portion 84. One end of the spring 91 is fixed to the shaft by attachment to disk 92.

Figure 6A:
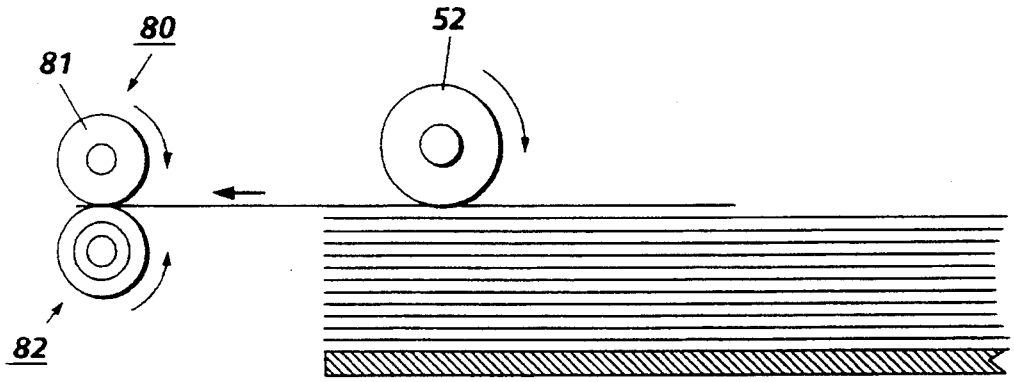
FIGS. 6A, 6B and 6C are elevational detail views illustrating the operation of a sheet feeder utilizing the FIG. 1 or FIG. 4 retard roll.
Figure 6B:
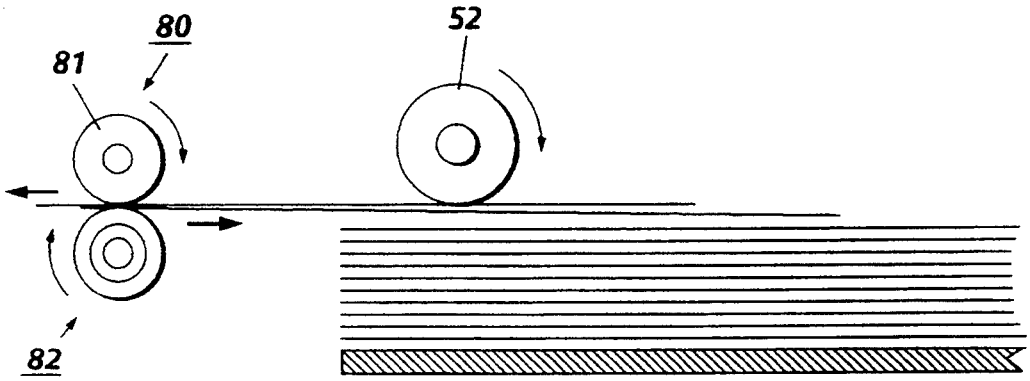
Figure 6C:
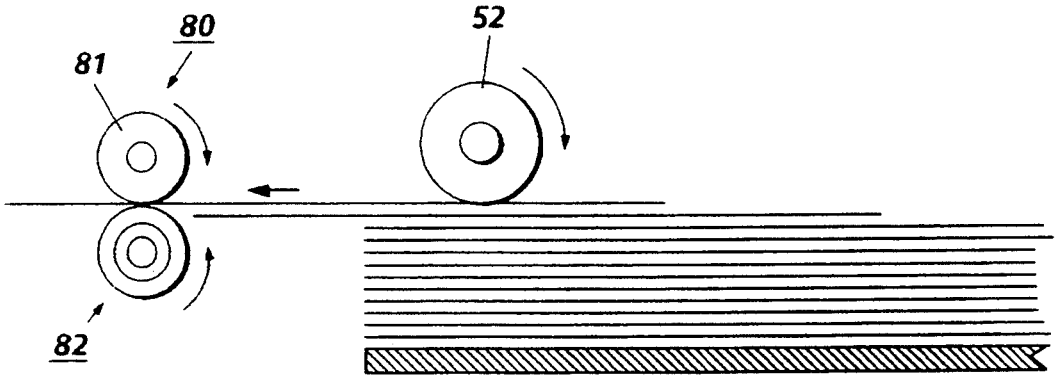

The operation of a retard feeder generally referred to as reference numeral 80 utilizing the above roll assembly 82 is illustrated in FIGS. 6A–6C inclusive. As the retard roll assembly 82 rotates due to frictional contact with a sheet being driven by frictional contact with the feed roll 81, friction between the spring 90 and the inner surface 85 of the cylindrical section 84 of the retard roll causes the spring to partially wind and contract circumferentially. Once a certain predetermined torque is reached (which is a function of the spring contraction), the torque overcomes the friction between the outer diameter of the spring 90 and the inner surface 85 of cylinder 84 (FIG. 6A). As single sheets continue to be fed through the retard nip, the torque imparted to the retard roll by contact with the sheet which is being contacted by and driven by the feed roll overcomes the frictional force between the spring 90 and the inner surface 85 of the retard roll, thereby allowing the roll to rotate or overrun the spring force in the feed direction. In the event a double sheet is forwarded to the nip, the torque transmitted to the feed roll is less than the torque stored in the spring 90, and as a result of the frictional forces between two sheets being considerably less than the frictional force between a single sheet and the feed roll and retard roll, the retard spring 90 causes the retard surface 86 to rotate in the direction opposite the feed direction causing any double sheets to be forced backwards towards the feed tray (FIG. 6B). Once the double sheets are pushed back out of the nip, a single sheet is once again fed through the nip and the spring 90 is again wound to provide the reverse biasing torque as the single sheet is driven through the nip (FIG. 6C). The design illustrated in FIGS. 1 through 3 is very compact, and as can be seen by the cutaway illustration in FIG. 3, the spring 90 is prevented from collapsing as a result of the inner portion of the spring being supported by fixed shaft 89.

Figure 4:
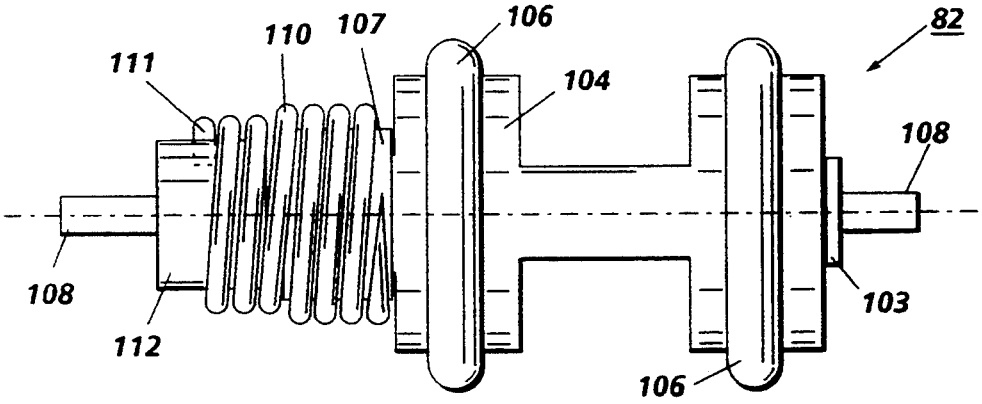
FIG. 4 is an elevational view of a second embodiment of a retard roll with an integral reverse biasing device.
Figure 5:
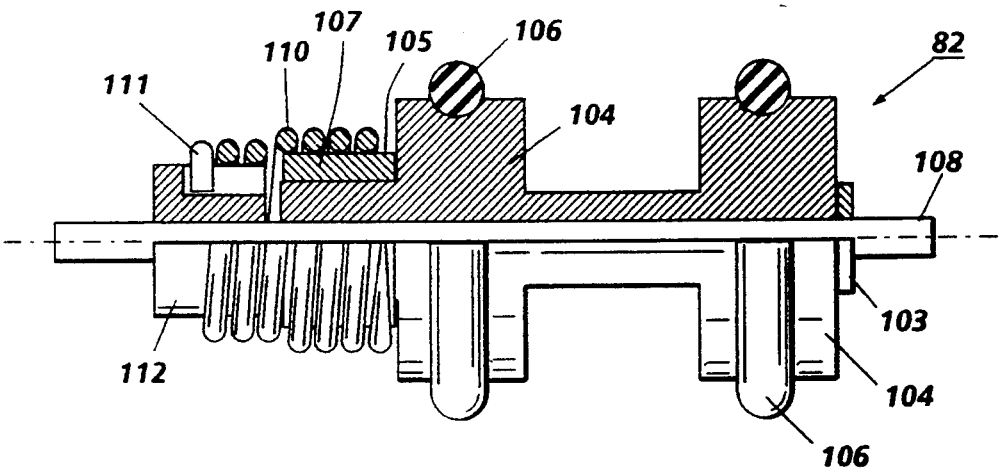
FIG. 5 is a partial sectional elevational view of the FIG. 4 retard roll.

Turning now to FIGS. 4 and 5, a second embodiment of the retard roll having an integral reverse biasing element is illustrated. A roll portion 104 is again supported on a fixed shaft 108. The roll is provided with elastomeric rings 106 to provide a frictional force between the roll portion 104 and the feed roll and the sheet. A wear ring 107 is fixed to one end of the roll portion 104. A wrapped spring is again fixed at one end 111 to disk 112 so that the end of the spring remains stationary and is fixedly attached to the shaft 108. Once again, as the retard roll assembly rotates by frictional contact with a single sheet being driven by the feed roll, the spring 110 is unwound from the outer diameter 105 of wear ring 107. Once a predetermined torque is reached, the inner diameter of the spring then slips relative to the wear ring, allowing the retard roll to overrun in the feed direction. Once again, if a double sheet enters the nip, the torque imparted to the retard roll is less than that stored by the spring and the spring 110 winds and through frictional contact with roll wear ring 107 which is attached to roll portion 104, the retard roll is caused to reverse direction and again feed the double sheets back toward the feed tray. This embodiment could also be utilized with a tapered spring and a conical wear ring attached to the retard roll.

Both of the above-described embodiments provide very compact units for feed assemblies. Additionally, there is a single component which provides both the slip clutch function and the reverse biasing function rather than a need for two separate components. The assemblies are made of relatively few parts and are easily repaired or replaced when worn.

The retard feeders described have been shown in use as copy sheet feeders but are equally well adapted for use in document handlers to feed original documents for imaging or in any other use in which sequential single sheet feeding is desired.

In recapitulation, there is provided a retard sheet feeder that utilizes a slip clutch with an integral biasing device to separate double fed sheets. A retard roll is provided in circumferential contact with a feed roll to form a drive nip. The retard roll is free to rotate in the feeding direction by the use of a spring that is axially aligned with the roll and allows the roll to slip in the feed direction once a predetermined torque level is reached. The spring may be either internal to the roll or external to the roll. When the drive torque to the retard roll is reduced such as when a double sheet is in the drive nip, the torque is not sufficient to overcome the stored spring energy and the roll is rotated in a reverse direction by the spring to drive the double sheet out of the nip. Once the double sheet is removed from the nip the frictional contact between the drive roll, a single sheet and the retard roll again winds the spring to the predetermined torque level at which point the spring slips allowing the retard roll to overrun in the feed direction.

It is, therefore, apparent that there has been provided in accordance with the present invention, a retard sheet feeder with an integral slip clutch with reversing torque that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus adapted to separate and advance sheets, comprising:

a sheet advancing device;

a retard roll in frictional contact with said advancing device and forming a nip therewith through which a sheet passes; and a unitary, dual function torque limiting biasing device, cooperating with said retard roll to allow said retard roll to rotate in a first direction as single sheets pass through the nip and to storing energy to rotate said retard roll in a second direction, opposite the first direction, to move the sheets in the opposite direction to that of a single sheet passing through the nip in response to a plurality of sheets passing into the nip, said dual function torque limiting biasing device is mounted internally of said retard roll and comprises a fixed shaft, a hollow cylindrical wear ring having an elastomeric coating on the external surface thereof so as to form a high coefficient of friction retard roll, said wear ring being rotatably supported on said shaft, and a resilient member comprising a wrap spring coaxially aligned with and in frictional contact with the inner cylindrical surface of said wear ring wherein a first end of said spring is rotationally fixed to said shaft so that rotation of said retard roll in the first direction causes said spring to rotate with said wear ring until reaching a predetermined biasing torque level and then slipping thereon and said spring further imparting a reversing torque to said wear ring when the frictional contact between said retard roll and said advancing device is below a level so as to overcome the biasing torque level.

2. The apparatus according to claim 1, wherein said sheet advancing device comprises a feed roll.

3. The apparatus according to claim 1, wherein said sheet advancing device comprises a feed belt.

4. The apparatus according to claim 1, further comprising a sheet stack support adapted to support the stack of sheets adjacent to said advancing device.

5. An electrophotographic printing machine of the type in which sheets are separated and fed from a stack, comprising:

a device for forming indicia on the sheets;

a sheet advancing device for feeding sheets to the device;

a retard roll in frictional contact with said advancing device and forming a nip therewith through which a sheet passes; and a unitary, dual function torque limiting biasing device, cooperating with said retard roll to allow said retard roll to rotate in a first direction as single sheets pass through the nip and storing energy to rotate said retard roll in a second direction, opposite the first direction, to move the sheets in the opposite direction to that of a single sheet passing through the nip in response to a plurality of sheets passing into the nip, said dual function torque limiting biasing device is mounted internally of said retard roll and comprises a fixed shaft, a hollow cylindrical wear ring having an elastomeric coating on the external surface thereof so as to form a high coefficient of friction retard roll, said wear ring being rotatably supported on said shaft and a resilient member comprising a wrap spring coaxially aligned with and in frictional contact with the inner cylindrical surface of said wear ring wherein a first end of said spring is rotationally fixed to said shaft so that rotation of said retard roll in the first direction causes said spring to rotate with said wear ring until reaching a predetermined biasing torque level and then slipping thereon and said spring further imparting a reversing torque to said wear ring when the frictional contact between said retard roll and said advancing device is below a level so as to overcome the biasing torque level.

6. The printing machine according to claim 5, wherein said sheet advancing device comprises a feed roll.

7. The printing machine according to claim 5, wherein said sheet advancing device comprises a feed belt.

8. The printing machine according to claim 5, wherein said sheet advancing device is used to feed original documents to be imaged.

9. The printing machine according to claim 5, wherein said sheet advancing device is used to feed copy sheets.

10. The printing machine according to claim 5, further comprising a sheet stack support adapted to support the stack of sheets adjacent to said advancing device.

* * * * *